United States Patent [19]

Noack

[11] Patent Number: 4,496,281

[45] Date of Patent: Jan. 29, 1985

[54] CENTRIFUGAL PUMP

[75] Inventor: Horst-Günter Noack, Witten-Annen, Fed. Rep. of Germany

[73] Assignee: Klöckner-Humboldt-Deutz AG, Fed. Rep. of Germany

[21] Appl. No.: 526,447

[22] Filed: Aug. 25, 1983

Related U.S. Application Data

[63] Continuation of Ser. No. 185,875, Sep. 9, 1980, , which is a continuation of Ser. No. 901,629, May 1, 1978.

[30] Foreign Application Priority Data

Apr. 9, 1977 [DE] Fed. Rep. of Germany ..... 2719168

[51] Int. Cl.[3] ..... F03B 11/02

[52] U.S. Cl. ..... 415/111; 415/219 C; 415/200

[58] Field of Search ..... 415/200, 206, 219 A, 415/219 B, 219 C, DIG. 3, 111

[56] References Cited

U.S. PATENT DOCUMENTS

| | | | |
|---|---|---|---|
| 1,527,635 | 2/1925 | Doran | 415/219 C |
| 2,312,422 | 3/1943 | Kumlin et al. | 415/219 C |
| 3,367,567 | 2/1968 | Burns | 415/219 C |

OTHER PUBLICATIONS

Sewage and Sludge Pumps by Wernert.
Krieselpumpen by Humboldt Wedag.

*Primary Examiner*—Henry C. Yuen
*Assistant Examiner*—John Kwon
*Attorney, Agent, or Firm*—Hill, Van Santen, Steadman and Simpson

[57] ABSTRACT

A centrifugal pump is disclosed having a low final construction and mounting cost and in which the assembly may proceed with prefabricated machine parts of standard size. The centrifugal pump has an axial inlet pipe, an impeller, an impeller shaft connected to the impeller, a bearing block retaining the impeller shaft, and a stuffing box surrounding the shaft. A pump housing has the inlet pipe at one side, and a stuffing box housing at the other side. The pump housing is comprised of two similarly constructed spaced apart wall parts. Around a periphery of the wall parts a spiral housing is provided. The wall parts and spiral housing are positioned between two holding discs which connect the wall parts to the spiral housing. The two holding discs are held together by bolts and one of the holding discs is connected to a holding plate which in turn connects with the bearing block via a base.

2 Claims, 3 Drawing Figures

CENTRIFUGAL PUMP

This is a continuation of application Ser. No. 185,875, filed Sept. 9, 1980 which in turn was a continuation of Ser. No. 901,629 filed May 1, 1978.

BACKGROUND OF THE INVENTION

The invention relates to a centrifugal pump, particularly for the conveyance of abrasive media and having axial inlet pipes and an impeller arranged in overhung fashion. A shield is provided in which a stuffing box housing is arranged for the mounting of the pump housing.

Known centrifugal pumps consist of many individual parts, mainly of cast metal. These individual parts in each case are suitable for one type of pump and pump size and are not usable with different types of pumps and pump sizes assembled of prefabricated machine parts.

SUMMARY OF THE INVENTION

It is an object of the invention to provide a centrifugal pump whose completion and mounting costs are low and in which in the asembly of prefabricated machine parts, different individual parts may be used with different pump sizes and types. The individual parts therefore have favorable costs and are easily produced. Such construction and arrangement techniques, however, result in a centrifugal pump capable of adaptation and operation with a high degree of efffectiveness.

The object is attained in that the pump housing has two wall parts of similar construction and extending outwardly from the inlet pipes or stuffing box housing. The wall parts are closed off by an annularly constructed spiral housing, and whereby the wall parts and the spiral housing are arranged between two holding discs which likewise extend outwardly from the inlet pipes or stuffing box housing. Through this arrangement, it is possible to omit the previous control division of the spiral housing and the different side parts required, as well as preventing couplings between the side parts and the spiral housing. The previous structure has been replaced by an arrangement with holding discs which can be simply produced out of roller material, which has favorable costs, and whereby in addition to the advantage of a simplified mounting, desired exchanges of worn parts within the holding discs is simplified.

In one embodiment, it is provided that the wall parts and the holding discs are secured to the inlet pipes or to the stuffing box housing and that the holding discs are connected with one another through the spiral housing by means of bolts. In this way, there results an advantageous connection of the holding discs with the inner parts and with one another which makes it possible to construct the pump out of five mounting parts. These mounting parts are: (1) the inlet pipes with holding disc and related wall part; (2) the spiral housing; (3) the impeller or wheel; (4) the bearing side wall part with the related wall part and the stuffing box housing; and (5) the bearing block with the holding shield and the impeller shaft. These five mounting parts are held mutually centered and are suitably secured together. In this connection, the parts, inlet pipes, wall parts, impeller wheel and spiral housing as well as the stuffing box housing are of highly alloyed chromium steel casting and the other parts not coming in contact with the abrasive media are of normal rolled steel. Thus a favorable cost suitable distribution results of the different materials according to their function, as well as simplified low-cost mounting since the corresponding units may be pre-mounted before the assembly and may be simply and easily combined or put together in the corresponding fittings and then bolted or secured.

In a further embodiment, the spiral housing has on the outside two hooks whose spacing corresponds to the spacing of the connection bolts. In this way, there results an advantageous fixing of the position of the spiral housing as compared with the holding discs, so that twisting of the spiral housing does not occur. Furthermore, after removal of the two connecting bolts which are in engagement in the hooks, contact elements are available for lifting devices. Also, the holding discs have contact or engaging elements for lifting devices.

In one embodiment, it is further provided that the holding discs in the area of the contact point with the wall parts and the spiral housing have recesses or bores which receive in centered fashion the corresponding projecting rings of the wall parts and the spiral housing. Through these recesses or bores, advantageously both the position of the holding discs and the wall parts are fixed with respect to one another and the spiral housing is secured. Through the projecting rings of the spiral housing and the wall parts, furthermore, an additional stiffening of these parts occurs.

Furthermore, in one embodiment holding discs at contact points with the inlet pipes or with the stuffing box housing respectively are recessed for receiving a corresponding ring of the inlet pipe or of the stuffing box housing, respectively, and that their inner diameters center the inlet pipes or the stuffing box housing, respectively. Through this technique, both in axial as well as also in the radial direction the position of the stuffing box housing is reliably established and exactly centered so that an easy and accurate mounting is insured.

It is furthermore provided that the holding plate has in its outer area a centering which engages in a recess of diameter similar to the corresponding holding disc, and so holds the pump housing centered, whereby the screws for securing of holding plate and holding disc have an angle division of 22.5°. Therefore, advantageously in an area in which the tilting force of the housing engages with great leverage, and in which a ring with large diameter may be arranged, the pump housing is held and centered with respect to the bearing block. Thus, by simple means (recess, welded ring, small screws) both a reliable and an accurate mounting is achieved. Also, through the 22.5° division, an easy adjustment of the position of the pressure pipe is possible and a deviation of 1/16 of the complete circle is possible in each case.

It is furthermore provided that the inlet pipe is constructed as a diffusor. Through this technique, the inlet speed of the abrasive medium in the interior of the centrifugal pump is lowered, which results in lower or less wear and at the same time increases the degree of efficiency. The additional costs which result from the utilization of a diffusor and which result in the enlargement of the pump chamber caused thereby are by far avoided through the simple favorable cost construction so that as a whole, compared with the earlier embodiment of the pump, an improved degree of efficiency results with simultaneous less pump cost.

It is furthermore provided in one embodiment that the outer impeller wheel diameter is smaller than the inner diameter of the spiral housing constructed of circular shape. In this manner, advantageously the expensive spiral housing as a casting part is minimized, and furthermore, the spiral housing may be removed at any time. In this way, the removal of the impeller from the impeller shaft is facilitated.

It is furthermore provided that the impeller wheel has back blades or vanes as well as a rectangular recess on the bearing side which is adapted to the inner diameter of the corresponding wall part so that a throttle gap is formed. By means of the back blades or vanes, the pressure on the outer side of the impeller wheel is lowered, so that on the inlet pipe side, no greater circulation results through the gap between diffusor and impeller, and on the stuffing box side in connection with the throttle gap, the pass through of rinsing or flushing liquid out of a flushing liquid conduit or of counterpressure water out of the stuffing box gland is decreased to a minimum.

It is further provided that the impeller shaft has in the area of the stuffing box gland a protective sleeve for the shaft which is pushed onto the impeller and is secured by means of a clamping element against twisting or distortion. Through this technique, advantageously the impeller shaft itself is protected from wear. The wear occurs with a simple wear component which can be produced cheaply.

It is furthermore provided that the impeller shaft has at the beginning of the intermediary bushing a centering shoulder and at its end, a centering pin. Through this embodiment, the impeller is secured on the impeller shaft at two points lying relatively far apart, and thus, an exact angular position is attained between impeller shaft and impeller.

Furthermore, it is provided that the bearing block and the holding plate have a welded construction, and that the bearing block is connected with the holding plate for welding also at the base by two protective plates welded on both sides of the impeller shaft. Through this embodiment, there results a simple connection at favorable cost but which is still sufficiently rigid between the bearing block and the pump housing. Also at the same time the advantage results that between the two protective plates in the lower area a collection tank for the counterpressure water issuing out of the stuffing box is formed.

Furthermore, it is provided that the impeller shaft has on the pump side of the bearing block a disc made of synthetic material with a rubber ring as an actuator and a V-packing sliding on the bearing cover of the bearing block about which is arranged a water collection plate. Thus, with simple means, the bearing block is protected from counterpressure water issuing out of the stuffing box, and at the same time, by means of the water collection plate, a spraying away of the water which collects between the two protective plates is prevented, and the water may be carried off through a pipe conduit. It further protects the bearing from water dripping from the outside.

It is further provided that the stuffing box housing has a rinsing or flushing and a counterpressure water inlet which are provided with flushing or counterpressure water control devices, preferably in the form of flow through inspection glasses, and which discharge in each case into a flushing or counterpressure water chamber. By the supply of flushing or rinsing liquid, advantageously a separation of the inner chamber of the pump filled by the abrasive medium from the stuffing box chamber is attained since the rinsing liquid during its passage through the narrow throttle gap completely fills the same and prevents the abrasive medium from reaching the stuffing box area. Through the counterpressure water, a cooling and lubrication of the stuffing box gland is attained. The corresponding flow through measuring devices thus take care of reliable control of the particular stream of rinsing liquid or counterpressure liquid, respectively.

DESCRIPTION OF THE PREFERRED EMBODIMENTS

Figure 1:
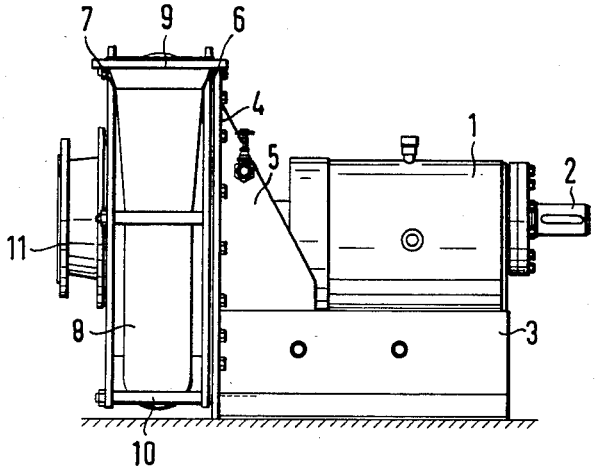
FIG. 1 is a view of the centrifugal pump of the invention.

In FIG. 1, the reference character 1 designates the bearing block and 2 the impeller shaft which is driven by means of a motor, not shown here in greater detail. The reference character 3 designates the bearing block foot which is formed of laterally arranged rectangular profiles and performs the function of the base plate, that is, the pump is placed directly on the foundation without a base plate.

Supporting plates 5 serve for mounting the holding plate 4 carrying the pump housing. These plates 5 are arranged on both sides adjacent to the impeller shaft 2. The holding plate 4 carries the two holding discs 6 and 7 which surround the annularly-shaped spiral housing with pressure pipes 9, and are connected with one another by means of the bolts 10. On the inlet side of the pump is arranged the inlet pipe 11 which is preferably constructed as a diffusor.

Figure 2:
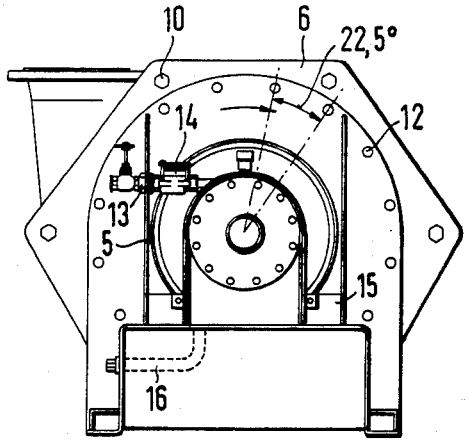
FIG. 2 is a side view of the centrifugal pump and showing the bearing block.

In FIG. 2 may be seen the angular shape of the holding discs (here hexagonal—however any other number of angles is possible). The shape of the holding discs is adapted to the outer contour of the spiral housing 8. The arrangement of the bolts 10 with reference to the spiral housing 8 is such that the bolts are arranged directly above the outer surface of the spiral housing 8, and that a bolt is located in the acute angle between spiral housing 8 and pressure pipes 9. The hexagonal shape of the holding discs 6, 7 changes with increasing size of the pumps. Larger pumps have preferably ten or sixteen angled holding discs.

The fastening of the spiral housing 8 on the plates 4 takes place by means of relatively small holding-screws 12 with a 22.5° division which permit an advantageous swinging by 1/16 of a full circle. From the side through the supporting plate 5, the counterpressure or rinsing water conduit 13 passes with a locking valve and the control device 14. On the bearing block side, the water collection chamber between the supporting plates for the counterpressure water or leakage water issuing out of the stuffing box is shut off by means of the closure plate 15. From the water collection chamber, the conduit 15 guides the water laterally through the foot of the bearing block.

Figure 3:
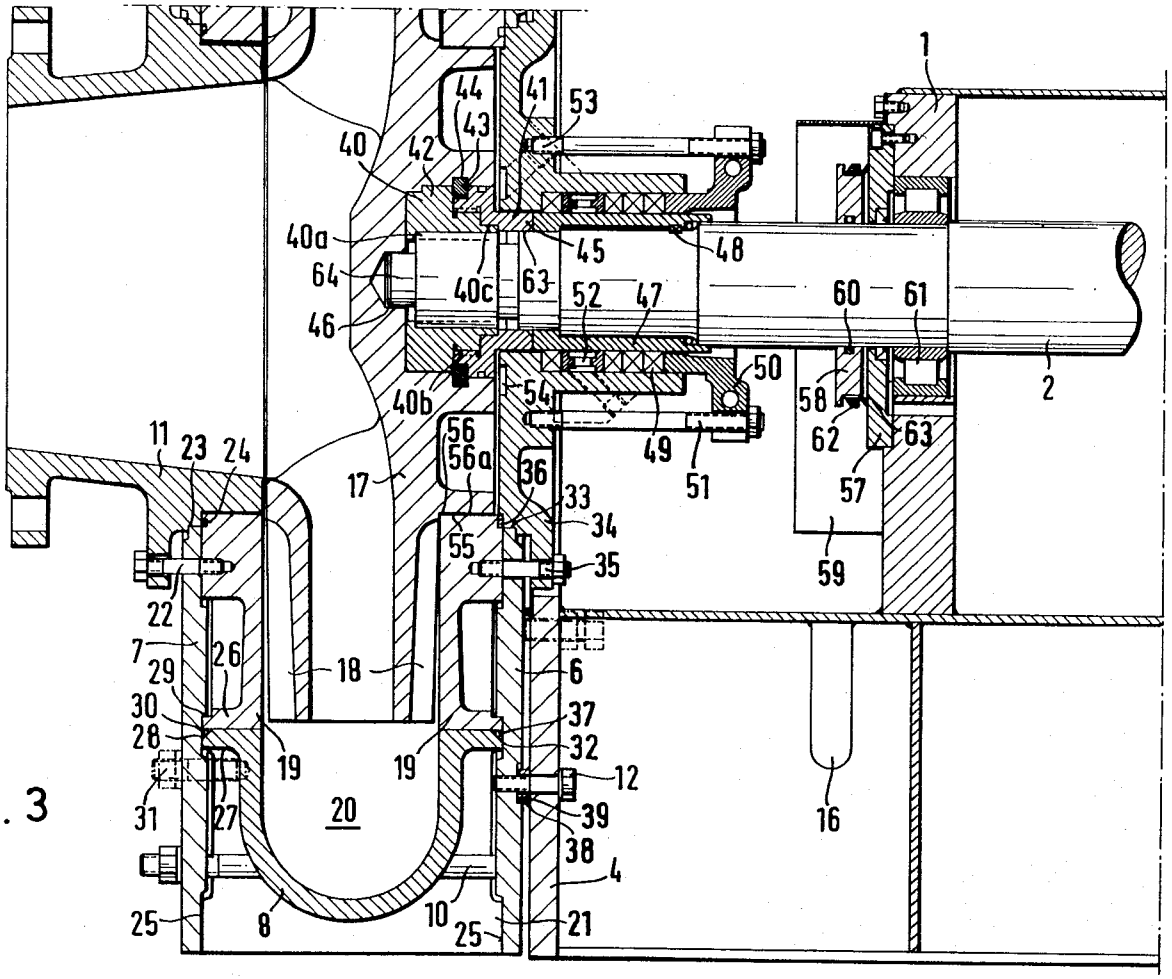
FIG. 3 is a cross-sectional view through the impeller shaft of the centrifugal pump.

In the sectional showing of FIG. 3, 11 designates on the suction side the diffusor to which the impeller 17 is attached at the inside. The impeller 17 which has back blades or vanes 18, passes between the wall parts 19 which are of equal construction. The pressure chamber 20 is closed off to the outside by the spiral housing 8. With pumps having large pressure heads, the spiral housing 8 is provided with ribs 21 which are so arranged that the bolts 10 which hold together the two holding discs 6 and 7 are in each case located directly adjacent a rib 21. The number of ribs 21 is accordingly either equal to the number of bolts 10 or amounts to an entire multiple thereof.

On the pump side of the diffusor, the wall part 19 with the holding disc 7 and a ring of the diffusor cast thereto, is secured by means of bolts 22, and whereby the surface 23 centers the diffusor. In order to seal against liquid which might pass through the gap between the wall part 19 and the diffusor 11, the packing 24 is located in front of the centering surface 23.

At the outer rim of the holding discs 6, 7 a recess 25 is provided in pumps for large pressure heads, which together with an outer processing in the form of a projecting abutment portion of the ribs 21, takes care of an outer support of the holding discs 6, 7. In spite of high inner pressure in the spiral housing, a deformation of the holding discs 6, 7 does not occur, so that both projecting rings 26 and 27 of the wall part 19 and of the spiral housing 8 as well as the opposite side of the recesses 28, 32 of the holding discs 6, 7 are reliably grasped and held. The radius is thereby determined through the installation of the ring 26 on the inner limit 29 of the recess 28. The radius is determined similarly on the opposite side. Between the rings 26 and 27 is located an O-ring seal 30.

In special cases involving a pump for extremely high stresses, an additional connection of the holding disc 7 with the spiral housing 8 occurs through the bolts 31. The bolt 31 thus engages in the foot of the ribs 21 which is wider than the diameter of the bolt 31.

Since the centering of the front wall part 19 takes place through the recess 28 in the holding disc 7, the centering of the rear wall part 19 also occurs through the recess 32 of the rear holding disc 6. On the inside of the holding disc 6 is attached in the same manner and centered like the diffusor on the outside, the stuffing box housing 34 centered from the inner edge 33. The latter is accordingly not fixed on the holding plate 4 or secured with the bearing block, but is centered through the holding plate 6 and is only connected with the same and the rear wall part 19 by means of the bolt 35. The bolt 35 combines the stuffing box housing 34 with the rear holding part 6 and the rear wall part 19 to one mounting unit just as the bolt 22 combines the inlet pipe 11 and the front wall part with the front holding disc 7 to another mounting unit. In the rear housing part of the pump housing are located corresponding packings 36 and 37 for the sealing of the wall part and the spiral housing as in the front housing part.

The fastening of the pump housing and its positioning takes place through the centering ring 38 which is welded onto the holding plate 4 and whose outer diameter is determined by fitting with the outer diameter of the recess 39 in the rear holding plate 6. The connection of the plate 4 through the centering ring 38 with the rear holding plate 6 occurs in this connection through the bolts 12 which are arranged in the already mentioned 22.5° angle division.

The impeller 17 has as a connection element for the impeller 2 shaft an intermediary bushing which preferably consists of a normal steel part 40 and a chromium steel part 41.

The normal steel part 40 is pushed fully into the boss or hub of the impeller 17, and an eccentric part 42 takes care of the transfer of the torsional or twisting moment of the intermediary bushing on the impeller. On the inside, the part 40 has a thread **40*a* through which it is connected with the impeller shaft 2. For the setting of the eccentric part 42 in an axial direction a ring 43 is provided consisting of several parts and which is inserted in the recess 44 of the impeller hub and is held on the inside by the chromium steel part 41. This part 41 is fixedly connected through the thread 40*a* with the accentric part 40. Through securing in the thread 40*b* and guidance of the chromium steel part on the shoulder 40*c* there results from the parts 40, 41 and 43 a constructed unit which, although easily and simply demountable, corresponds mechanically to an impeller embodiment with a onepiece hub. Removal of the intermediary bushing takes place by means of turning the chromium-steel part 41, (for this purpose, the centering shoulder 45 projecting out of the impeller does not have engagement surfaces for tools shown in greater detail). The centering of the impeller takes place both through the centering shoulder 45 as well as also in the impeller recess 46, so that a wobble-free course of the impeller is insured. At the bearing block side on the intermediary bushing is attached a shaft protecting sleeve 47 which by means of a clamping element 48 is prevented from twisting on the shaft 2. In the area of the shaft protecting sleeve 47 is located the stuffing box packing 49 which in known manner is drawn by means of the stuffing box gland 50 thru the bolts 51. In the impeller side portion of the stuffing box packing 49 is located a counterpressure annular channel 52, into which, as indicated, counterpressure water may be introduced. Particularly with very aggressive media there is supplied to the pump, in addition to counterpressure water, rinsing water to the pump through the indicated supply line 53, which is delivered through the rinsing water channel 54 at the same time to the rear gap between impeller 17 and stuffing box housing 34. From the gap between impeller 17 and stuffing box housing 34, the rinsing water arrives through the throttle gap 55 between the inner edge 56 of the rear wall part 19 and the throttle gap recess 56*a* of the impeller into the chamber of the rear blade or vane 18**. Through the construction of the rear blade or vane, even at high pressure, only a low pressure is present in the spiral housing, so that a relatively low rinsing liquid pressure is sufficient in order to obtain a flow-through of the throttle gap with fresh rinsing water. By use of the counterpressure water and rinsing water the maintenance and supervision of the pump is facilitated; an issuance of corrosive media out of the pump interior is reliably prevented.

Eventually, between the shaft protection sleeve 47 and the stuffing box packing 49, rinsing water passing through is centrifuged out by the centrifugal disc 58 arranged in front of the bearing plate 57 and against the spray water collection housing 59, and drips off from here into the water collection chamber between the supporting plates 5 and the rear closure 15, from which it is conveyed away through the pipe conduit 16. The centrifugal disc 58 is actuated by the impeller shaft 2 by means of the rubber ring 60. In order to prevent the stuffing box water from passing out and extending into the bearing 61, the centrifugal disc 58 is provided with a cooperating V-packing 62 whose self releasing lip 63 in operation insures a constantly watertight seal.

In addition the bearing block in correspondence with the problem selected is made as sturdily and simply as possible for the durability of the pump as necessary on the one hand, and on the other hand, without influencing the quality. In the same fashion, it can also be seen that the parts of the pump which come in contact with the abrasive media, that is, diffusor, impeller, spiral housing, wall parts, stuffing box housing and rear side of the intermediary bushing, consist of corrosion and wear-proof material, for example, highly alloyed chromium steel. All other parts, such as the holding discs, the bearing block and the plate for receiving the pump housing are produced of roller material and are provided in welded construction. As a whole, through the simple, smooth form of the parts, the frequently required middle securing of the spiral housing and the possibility of combining different impeller shafts and impellers with different housing constructions and bearing blocks is eliminated—a type of construction previously not attainable.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A centrifugal pump for the conveyance of abrasive media under large pressure, comprising:

an axial inlet pipe;

an impeller arranged in overhung fashion on an impeller shaft;

a stuffing box housing surrounding the shaft;

a pump housing connecting to the inlet pipe and stuffing box housing, said pump housing comprising two similarly constructed wall parts, one wall part extending from the inlet pipe outwardly and the other wall part extending from the stuffing box housing outwardly, a spiral housing of annular shape and a laterally projecting ring on each side thereof, said spiral housing being in contact with outer portions of the wall parts to create an enclosed area within which the impeller is housed, and two planar holding discs constructed of rolled material between which the two wall parts and spiral housing are mounted, one of said holding discs extending from the inlet pipe outwardly and the other holding disc extending from the stuffing box housing outwardly, connecting bolts positioned external to the spiral housing pulling the two holding discs toward each other so as to provide direct contact with the laterally projecting ring on the spiral housing;

a holding plate connecting to one of the holding discs to support the pump housing;

a rib projecting radially outwardly from and beyond the spiral housing between the holding discs in a direction perpendicularly thereto and directly adjacent each of the connecting bolts, each rib having an outer processing in the form of a projecting abutment portion abutting in a corresponding recess in an outer rim completely outwardly of the connecting bolts of each of the holding discs so as to provide an outer support of the holding discs outwardly of the connecting bolts and so as to strengthen the pump housing to permit handling large pressure heads; whereby the rib projecting abutment portions and spiral housing ring cooperate with the holding discs and connecting bolts to provide a centrifugal pump having a spiral housing formed of low cost material and able to withstand large pressure heads.

2. The pump of claim 1 wherein bolts are provided which secure one of the holding discs to a respective rib to strengthen the pump housing.

* * * * *